US006582202B2

(12) United States Patent
Fujii et al.

(10) Patent No.: US 6,582,202 B2
(45) Date of Patent: Jun. 24, 2003

(54) COMPRESSOR AND METHOD OF LUBRICATING THE COMPRESSOR

(75) Inventors: Toshiro Fujii, Kariya (JP); Kazuo Murakami, Kariya (JP); Yoshiyuki Nakane, Kariya (JP); Kenichi Morita, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 09/913,456

(22) PCT Filed: Dec. 11, 2000

(86) PCT No.: PCT/JP00/08754

§ 371 (c)(1),
(2), (4) Date: Jan. 14, 2002

(87) PCT Pub. No.: WO01/44660

PCT Pub. Date: Jun. 21, 2001

(65) Prior Publication Data

US 2002/0159894 A1 Oct. 31, 2002

(30) Foreign Application Priority Data

Dec. 14, 1999 (JP) ..... 11-354851

(51) Int. Cl.[7] ..... F04B 1/12; F01M 1/00
(52) U.S. Cl. ..... 417/269; 184/6.16
(58) Field of Search ..... 417/269; 184/6.17, 184/6.16, 6.18

(56) References Cited

U.S. PATENT DOCUMENTS

| | | | | | |
|---|---|---|---|---|---|
| 2,963,113 | A | * | 12/1960 | Ayling | 184/6.18 |
| 3,945,765 | A | | 3/1976 | Toyoda et al. | 417/269 |
| 4,624,629 | A | * | 11/1986 | Murayama et al. | 184/6.16 |
| 4,749,344 | A | * | 6/1988 | Tomita et al. | 184/6.18 |
| 5,301,771 | A | * | 4/1994 | Sishtla et al. | 184/6.12 |
| 5,580,224 | A | * | 12/1996 | Ikeda et al. | 184/6.17 |
| 6,129,532 | A | | 10/2000 | Kato et al. | 417/55.6 |

FOREIGN PATENT DOCUMENTS

| | | | | | |
|---|---|---|---|---|---|
| DE | 195 20 267 | A1 | | 6/1995 | F04B/39/16 |
| DE | 199 07 492 | A1 | | 8/1999 | F04B/37/10 |
| EP | 0 738 832 | A1 | | 10/1996 | F04B/27/10 |
| EP | 0 926 346 | A2 | | 6/1999 | F04B/49/06 |
| JP | 63-20864 | | | 6/1988 | F04B/27/08 |
| JP | 07-027047 | A | | 1/1995 | F04B/27/08 |
| JP | 7-332239 | | | 12/1995 | F04B/39/02 |
| JP | 10-141227 | A | | 5/1998 | F04B/39/00 |
| JP | 10-141227 | | * | 5/1998 | F04B/39/00 |
| JP | 10-246182 | | * | 9/1998 | F04B/27/08 |
| JP | 11-294597 | | * | 10/1999 | F16J/15/34 |

* cited by examiner

*Primary Examiner*—Charles G. Freay
*Assistant Examiner*—Timothy P. Solak
(74) *Attorney, Agent, or Firm*—Morgan & Finnegan, LLP

(57) ABSTRACT

In a compressor that is configured to guide the lubricating oil separated from the discharged refrigerant by an oil separator to the radial bearing supporting the drive shaft, through an oil supply hole 29, a rotating member 30 that rotates together with said drive shaft is provided adjacent to the radial bearing on the drive shaft. Moreover, an outlet 29*a* of the oil supply hole 29 opens to the internal surface of a circular hole 31 that supports the rotating member 30. A channel 34 for restricting the flow rate comprises a gap defined between the rotating member 30 and the circular hole 31, and restricts the flow rate discharged front the oil supply hole 29 to the radial bearing, and at the same rime, the rotation of the rotating member 30 sweeps out foreign substances, such as sludge, from the outlet 29*a* of the oil supply hole 29.

10 Claims, 4 Drawing Sheets

COMPRESSOR AND METHOD OF LUBRICATING THE COMPRESSOR

TECHNICAL FIELD

The present invention relates to a compressor that is ideal for a vehicle air-conditioning system, and more specifically to a lubrication technique that guides lubricating oil to lubrication target areas, such as the bearing of a drive shaft and the sliding surface between a piston and a cylinder bore.

BACKGROUND ART

A compressor that guides lubricating oil to the bearing of a drive shaft is disclosed, for example, in Japanese Laid-Open Patent Publication No. 7-27047. The compressor described in this publication is a swash plate compressor, in which a refrigerant gas that is discharged into a discharge chamber is guided to an oil separator provided in a cylinder block, thereby separating the lubricating oil from the refrigerant gas, and then the separated lubricating oil is guided to the bearing of a drive shaft via an oil supply hole provided in the cylinder block for lubrication.

The compressor configured as described above guides the oil separated from the discharged refrigerant to the bearing for lubrication, using the pressure difference between the oil separation chamber, which is at a higher pressure, and a drive chamber, which is at a lower pressure, and then returns the oil to the drive chamber. Consequently, if the diameter of the lubricating oil supply hole formed in the cylinder block is too large, leakage of the discharged refrigerant causes a degradation in performance, and leakage of a large amount of high-temperature lubricating oil heats the refrigerant that has been drawn in, thereby causing performance degradation. On the other hand, if the oil supply hole is too small, foreign substances, such as sludge (oil sludge), tend to clog the oil supply hole, and manufacturing such a small hole is also difficult.

Especially when a compressor uses carbon dioxide ($CO_2$) as the refrigerant, the operation pressure difference (the difference between a discharge pressure and a suction pressure) is large (5 MPa or greater) and therefore, said conflicting requirements become more difficult to satisfy.

The present invention has been developed in view of said existing problems, and its objectives are to prevent the clogging of the oil supply hole by foreign substances, such as sludge, and to avoid performance degradation caused by leakage of the discharged refrigerant.

DISCLOSURE OF THE INVENTION

In order to achieve the above objectives using a compressor related to the present invention, when a lubricating oil is sent to a lubrication target area via an oil supply hole, a flow rate restriction channel communicated to the outlet of the oil supply hole restricts the flow of the lubricating oil, thereby reducing the flow rate. The channel is defined between a cylindrical hole and a member that rotates or reciprocates inside this cylindrical hole. Consequently, even when foreign substances, such as sludge, flow from the oil supply hole to the channel, the foreign substances are swept out from the outlet of the oil supply hole due to the relative movements of the members that define the channel.

Therefore, according to the present invention, clogging of the oil supply hole by foreign substances can be prevented and performance degradation caused by leakage of the discharged refrigerant can also be avoided.

Moreover, because the channel is defined by a gap between the cylindrical hole and the member that rotates or reciprocates inside the cylindrical hole, the channel can be formed more easily than a case in which a channel is formed by boring.

Note that in this case, the lubricating oil to be sent to the lubrication target area should preferably be lubricating oil that has been separated from the discharged refrigerant, and should preferably be guided based on the pressure difference between the discharged side and the suction side. Such a configuration is especially effective when applied to a compressor that uses carbon dioxide as the refrigerant.

Moreover, when a channel is defined by the gap between the external surface of a rotating member that rotates together with the drive shaft and the internal surface of a circular hole in which the rotating member fits, foreign substances, such as sludge, that flow in via the oil supply hole are swept out from the outlet due to the rotation of the rotating member, thereby preventing the clogging of the oil supply hole, and leakage of the discharged refrigerant is suppressed, thereby avoiding performance degradation.

Note that in this case, it is preferable to provide a foreign substance sweep-out groove on the external surface of the rotating member and the foreign substance sweep-out groove intermittently communicates with the outlet of the oil supply hole. In such a case, whenever the groove faces the outlet of the oil supply hole, foreign substances, such as sludge, that flow in via the oil supply hole can be captured. Therefore, the sweeping of foreign substances, such as sludge, can be more actively performed, making it possible to more effectively prevent the clogging of the oil supply hole.

When the sliding surface between a piston and a cylinder bore is the lubrication target area, the flow rate of the lubricating oil flowing into the sliding surface via the oil supply hole is controlled by the channel defined between the piston and the cylinder bore. When the piston reciprocates inside the cylinder bore, foreign substances, such as sludge, are moved by adhering to the piston or with the lubricating oil. This action prevents the clogging of the oil supply hole and suppresses leakage of the discharged refrigerant, thereby avoiding performance degradation.

Note that in this case, a stepped surface is provided at the boundary between the gap comprising the channel and the side clearance between the external surface of the piston and the internal surface of the cylinder bore. This stepped surface should preferably be provided in a position that crosses the outlet of the oil supply hole when the piston moves toward the bottom dead center. With such a configuration, foreign substances, such as sludge, flowing in via the oil supply hole can be swept out from the outlet of the oil supply hole by the stepped surface. Moreover, it is preferable to use a configuration in which the stepped surface extends outside the cylinder bore when the piston is positioned at the bottom dead center. With such a configuration, the captured foreign substances can be reliably swept out of the cylinder bore through the outlet of the oil supply hole.

Furthermore, the channel defined between the piston and the cylinder bore should preferably comprise a groove that is provided on the external surface of the piston and that extends in the axial direction. With such a configuration, the channel can increase the flow-restriction effect, thereby better restricting leakage of the discharged refrigerant. Moreover, the foreign substances swept out from the oil supply hole should preferably be discharged into a drive chamber having a relatively large space.

EMBODIMENTS OF THE INVENTION

Figure 1:
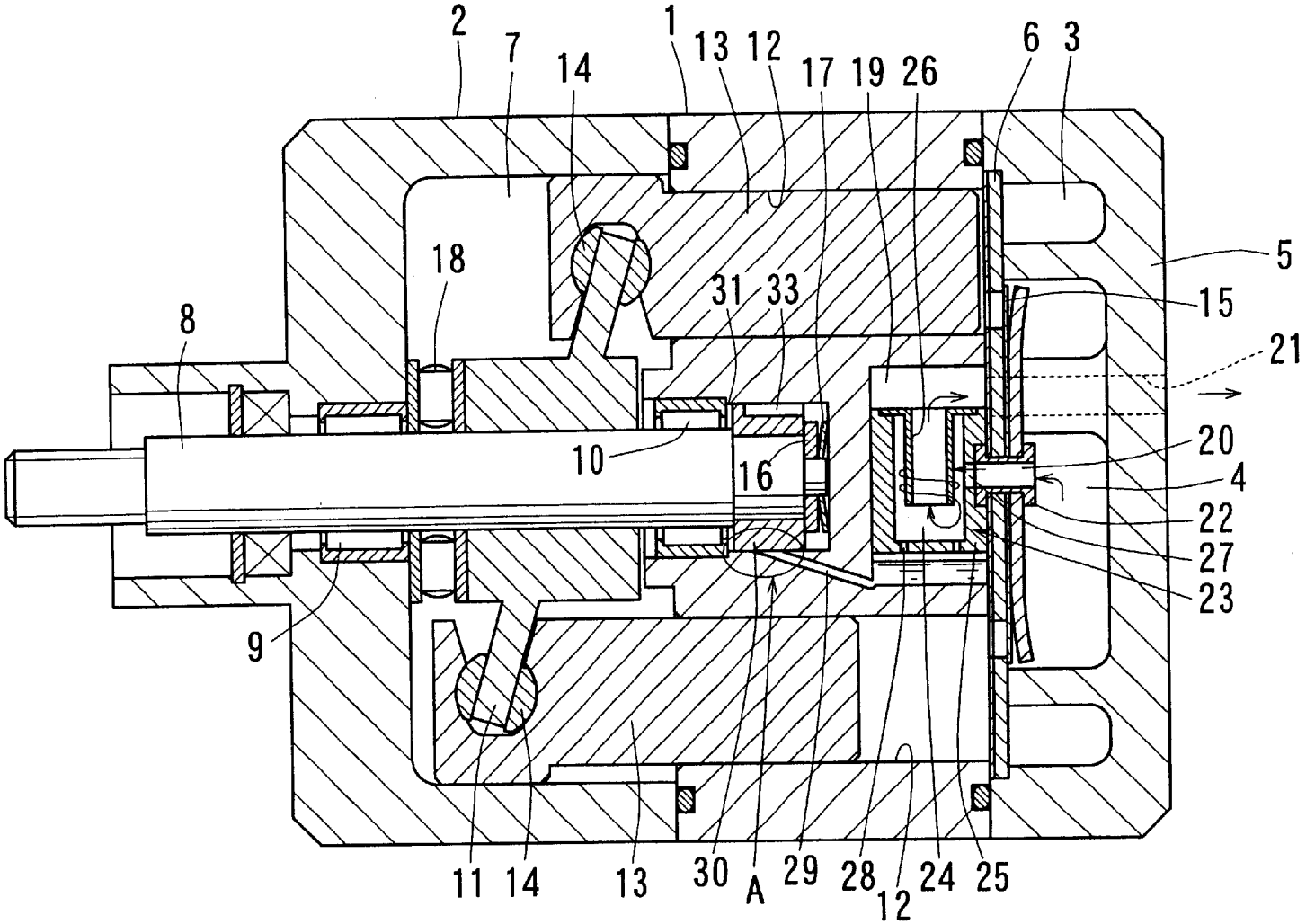
FIG. 1 is a cross-sectional diagram showing a compressor related to the present embodiment.

Embodiments of the present invention will be explained below with references to the drawings. As shown in FIG. 1, the embodiments of the present invention are applied to a swash plate compressor. A front housing 2 is joined to the front end of a cylinder block 1, which comprises part of the external frame of the compressor; a rear housing 5, in which an suction chamber 3 and a discharge chamber 4 are defined, is joined to the rear end via a valve plate 6.

A drive shaft 8 that will be connected to a power source is inserted through the drive chamber 7 formed inside the front housing 2, and the drive shaft 8 is rotatably supported by the cylinder block 1 and the front housing 2 via radial bearings 9 and 10, respectively. A swash plate 11 is disposed inside the drive chamber 7 and is secured to the drive shaft 8.

Moreover, the cylinder block 1 has multiple cylinder bores 12 that are bored at predetermined intervals in the circumferential direction, and a piston 13 is slidably fitted inside each of the cylinder bores 12. The front end of the piston 13 extends into the drive chamber 7, and at the same time, is engaged with the swash plate 11 via a shoe 14.

Therefore, when the drive shaft 8 is rotated, its rotational movement is converted into linear reciprocal movements of the piston 13 via the swash plate 11 and the shoe 14. Due to the reciprocal movements of the piston 13 inside the cylinder bore 12, the refrigerant inside the suction chamber 3 is drawn into the cylinder bore 12 via an suction valve (omitted from the figure), and is discharged to the discharge chamber 4 via a discharge valve 15 while being compressed. The top portion of FIG. 1 shows the piston 13 at the top dead center (discharge completion position) while bottom portion shows piston 13 at the bottom dead center (suction completion position).

A circular hole 31, one of whose ends opens to the drive chamber 7, is provided in the shaft core area of the cylinder block 1, and the radial bearing 10, which supports the drive shaft 8, as well as a rotating member 30, which will be described below, are positioned inside the circular hole 31, and moreover, a thrust race 16 and a disc spring 17 for urging the rear end of the drive shaft 8 forward are disposed on the bottom of the hole 31. The urging force of the disc spring 17 is then supported by a thrust bearing 18, which is positioned between the swash plate 11 and the front housing 2.

A chamber 19 is provided in the center of the cylinder block 1, which faces the valve plate 6, and the chamber 19 communicates with the discharge chamber 4 via a first discharge channel 20 in approximately the mid-section in the vertical direction, and communicates with a cooling circuit, which is an external circuit, via a second discharge channel 21 on the top side. Note that the first discharge channel 20 is bored through a fixture 22 used for securing the discharge valve 15 to the valve plate 6.

A centrifugal separation oil separator 23, which separates the lubricating oil from the high-pressure refrigerant gas sent out to the cooling circuit via the chamber 19, is disposed inside the chamber 19. The oil separator 23 consists of a base 25, which has a separation chamber 24 that is in the shape of a circular hole with a bottom, and a flanged gas-guiding tube 26 installed in the base 25 so as to concentrically hang down from the upper opening edge of the separation chamber 24; a throughhole 27, which permits the separation chamber 24 to communicate with the first discharge channel 20, is provided on the side wall of the base 25. The throughhole 27 opens almost tangentially toward the inside of the separation chamber 24.

Therefore, the lubricating oil that is force-fed and guided into the separation chamber 24 together with the refrigerant gas by circling around the gas-guiding tube 26 from the first discharge channel 20 via the throughhole 27 collides with the perimeter wall of the separation chamber 24 due to centrifugal force, at the same time, is separated from the refrigerant and flows down, and collects on the bottom of the chamber 19 by passing through a throughhole 28 provided on the bottom wall of the separation chamber 24.

Further, the discharged refrigerant from which the lubricating oil has been separated is sent to the cooling circuit from the gas-guiding tube 26 via the second discharge channel 21.

Figure 2:
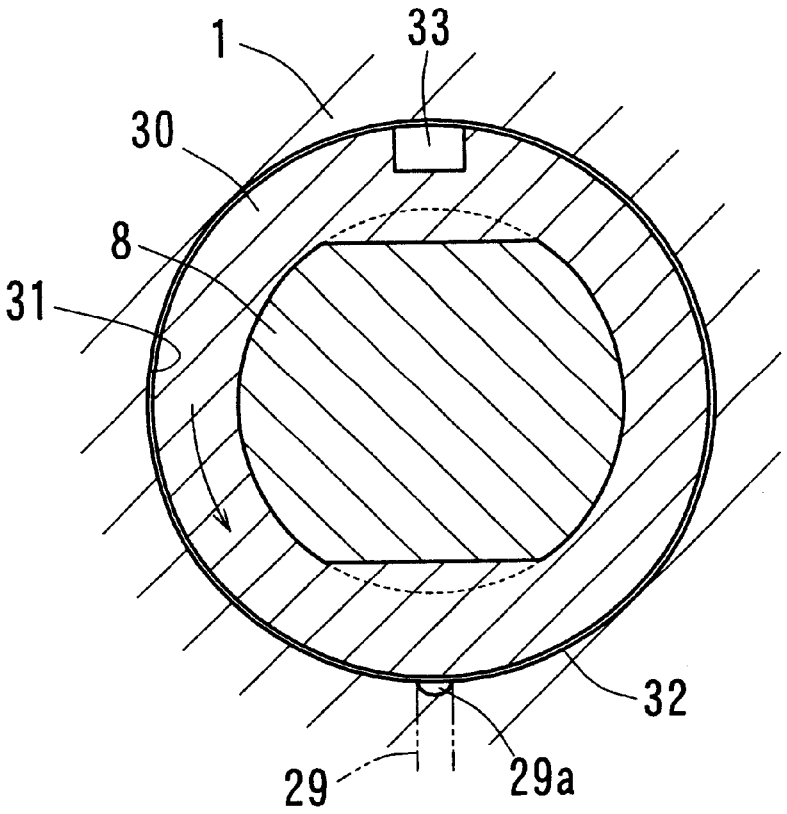
FIG. 2 is a magnified cross-sectional diagram showing the rotating member and the oil supply hole.
Figure 3:
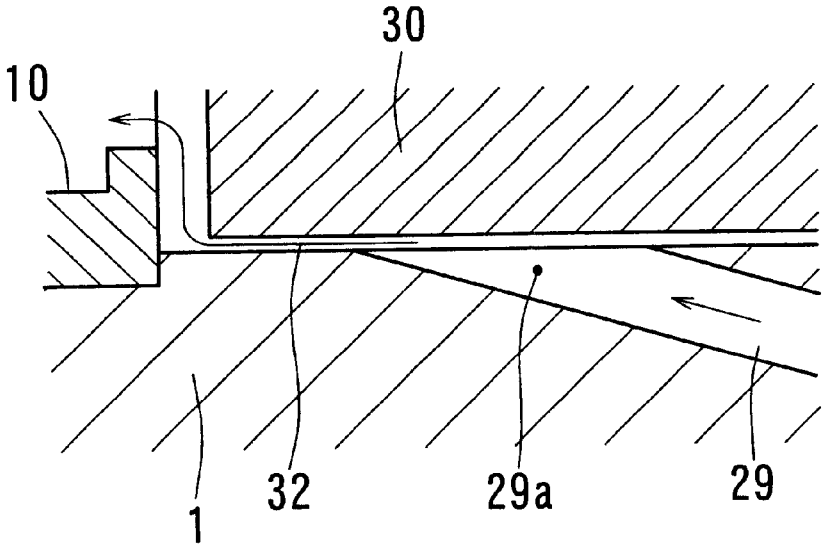
FIG. 3 is a magnified view of Area A in FIG. 1.

As shown in FIGS. 1, 2 and 3, an oil supply hole 29 for guiding the lubricating oil collected inside the chamber 19 to the radial bearing 10 of the drive shaft 8 is defined in the cylinder block 1. The inlet of the oil supply hole 29 opens to the bottom of the chamber 19 and its outlet 29*a* (see FIGS. 2 and 3) opens to the part of the internal surface of a circular hole 31 that faces the external surface of a rotating member 30.

The rotating member 30 is positioned adjacent to the radial bearing 10 and is fitted by the width across flats on the rear end of the drive shaft 8 (see FIG. 2), and rotates together with the drive shaft 8. The rotating member 30 is fitted into the circular hole 31 formed in the cylinder block 1, with a gap, and one end of this gap faces the side surface of the radial bearing 10. That is, as shown in the magnified view in FIG. 3, the gap defines a channel 32 for controlling (reducing) the flow rate of the lubricating oil, and the oil supply hole 29 communicates with the radial bearing 10 of the drive shaft 8 via the channel 32. In other words, the channel 32 is defined such that the area determined by the perimeter of the outlet 29*a* and the height of the channel 32 (the gap between the rotating member 30 and the circular hole 31) is significantly smaller compared to the area of the outlet 29*a* of the oil supply hole 29. In this way, the channel 32 functions as a restricting channel.

A single groove 33, which extends in the axial direction for actively sweeping out foreign substances, such as sludge, is defined on the external surface of the rotating member 30. One end of the groove 33 in the axial direction opens to the bottom of the circular hole 31, and the other end which faces the radial bearing 10 is closed.

The compressor related to the embodiment of the present invention is configured as described above. Therefore, when the piston 13, which is coupled to the swash plate 11 rotating with the drive shaft 8, reciprocates inside the cylinder bore 12, the compression work begins and the compressed refrigerant gas pushes open the discharge valve 15 and is discharged into the discharge chamber 4, and is then guided from the first discharge channel 20 into the chamber 19. Then, the lubricating oil within the refrigerant gas, which is introduced into the chamber 19 while circulating, is separated from the refrigerant gas by a centrifugal force inside the separation chamber 24, flows down the wall of the separation chamber 24 due to gravity, and is collected via the throughhole 28 on the bottom of the chamber 19.

As indicated by the arrows in FIG. 3, the lubricating oil collected inside the chamber 19 is force-fed from the oil supply hole 29 via the channel 32 to the radial bearing 10 of the drive shaft 8, which has a lower pressure than the pressure (discharge pressure) inside the chamber 19, and after lubricating the radial bearing 10, is released into the drive chamber 7.

During this process, the flow rate of the lubricating oil that flows out from the outlet 29*a* of the oil supply hole 29 is restricted by the channel 32 defined between the external surface of the rotating member 30 and the internal surface of the circular hole 31. That is, the flow rate of the lubricating oil that is fed via the oil supply hole 29 is restricted using the cross-sectional area of the channel (gap) 32 as the minimum throttle when flowing to the radial bearing 10. This design can suppress leakage of the discharged refrigerant inside the chamber 19 to the drive chamber 7 via the oil supply hole 29 for the lubricating oil.

On the other hand, if foreign substances, such as sludge, flow in via the oil supply hole 29, such foreign substances are swept out from the outlet 29*a* of the oil supply hole 29 due to the rotational movement of the rotating member 30. That is, foreign substances that stick out into the narrow channel 32 from the outlet 29*a* under high pressure are, moved by the rotational movement of the rotating member 30, and then moved by adhering to the rotating member 30 or moved through the channel 32 to the radial bearing 10 together with the lubricating oil. This sweeping action prevents clogging by foreign substances.

In the present embodiment, the groove 33, which extends in the axial direction, is formed on the external surface of the rotating member 30, and therefore, by having the groove 33 intermittently face the outlet 29*a* of the oil supply hole 29, foreign substances can be actively captured and swept out. Clogging of the oil supply hole 29 is thus prevented, and excellent lubricating effects can be obtained by eliminating a lubricating oil shortage that will be caused by a clogged hole. Note that as the volume of the foreign substances captured in the groove 33 increases, the foreign substances are gradually sent out to and are collected on the bottom of the circular hole 31 from the open end of the groove 33. During this process, foreign substances are prevented from flowing out to the radial bearing 10 because the other end of the groove 33 is blocked.

As explained above, according to the present embodiment, in a lubricating oil supply system for the radial bearing 10 of the drive shaft 8, clogging of the oil supply hole 29 by foreign substances, such as sludge, can be prevented, and at the same time, performance degradation due to refrigerant leakage can be avoided by reducing leakage of the refrigerant.

In the present embodiment, by having the channel 32 that communicates with the outlet 29*a* of the oil supply hole 29 restrict the flow rate, the hole diameter of the oil supply hole 29 can be set large, making the boring process easy. Additionally, because the channel 32 includes the gap between the rotating member 30 and the circular hole 31, manufacturing is easier than a case in which the channel is formed by boring.

Figure 4:
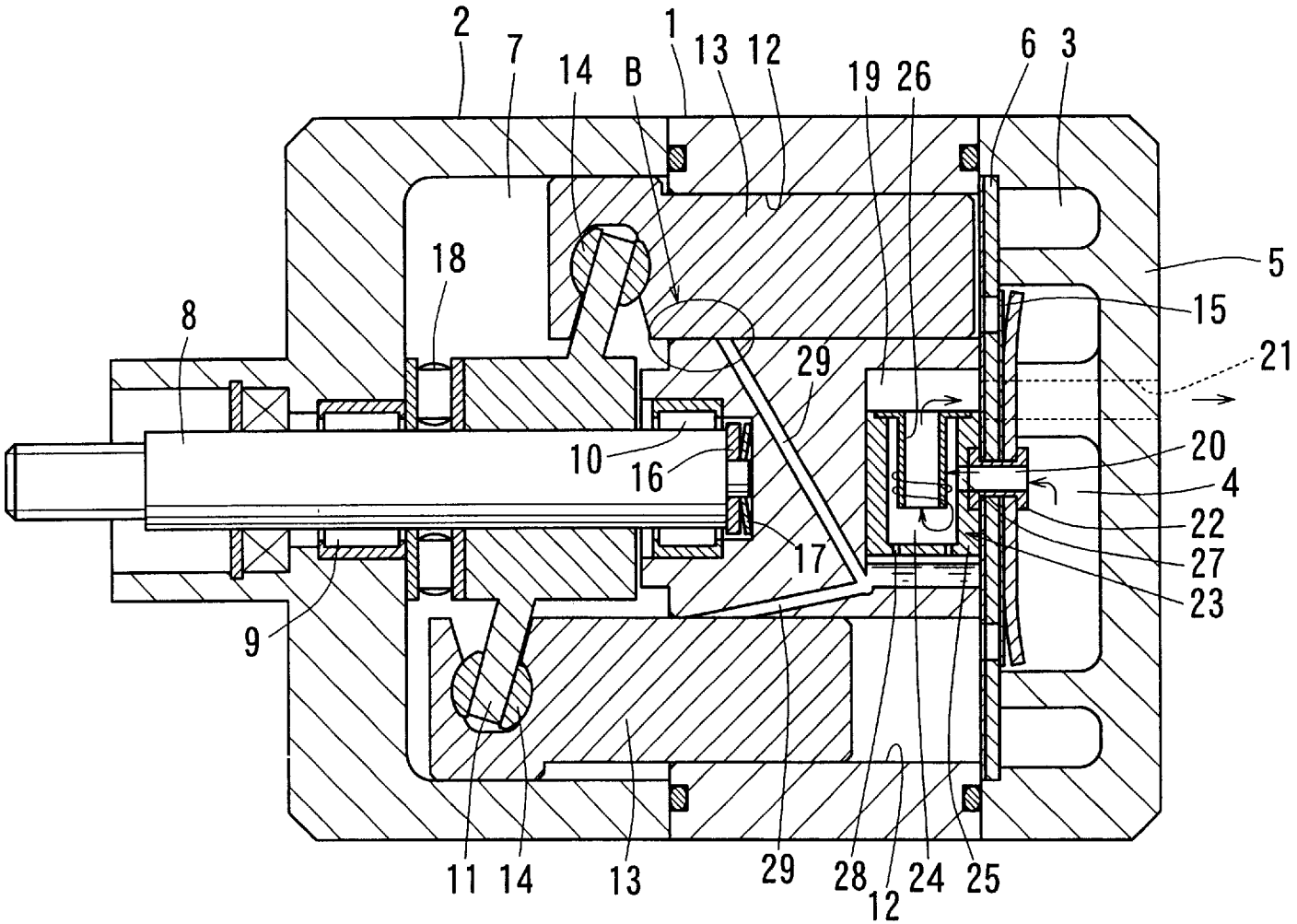
FIG. 4 is a cross-sectional diagram showing a compressor that relates to another embodiment.

Next, another embodiment of the present invention will be explained with references to FIGS. 4 and 5. In this embodiment, the cylinder bore 12 and the piston 13 that reciprocates inside the cylinder bore 12 are the lubrication target areas. As shown in the figures, the inlet of the oil supply hole 29 provided in the cylinder block 1 opens to the bottom surface of the oil separator 23 and the outlet 29*a* thereof opens to the internal surface of the cylinder bore 12.

Figure 5:
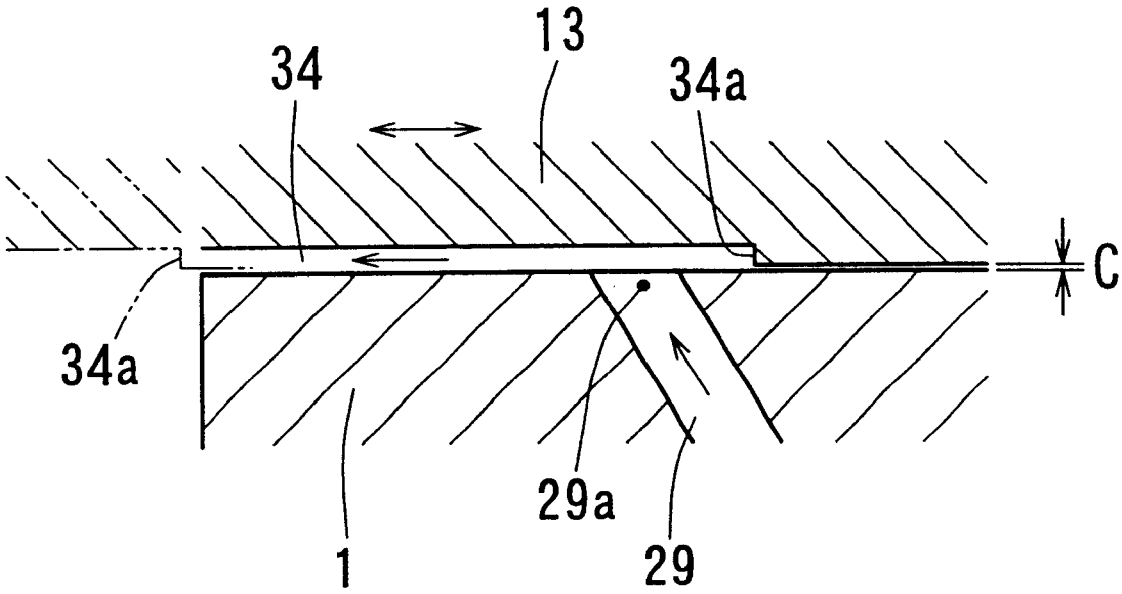
FIG. 5 is a magnified view of Area B in FIG. 4.

Furthermore, as shown in FIG. 5, a groove provides a gap of a predetermined size from the internal surface of the cylinder bore 12 and is defined on the external surface of the piston 13 in a location that faces the outlet 29*a* of the oil supply hole 29. That is, this groove defines a channel 34 for restricting the flow rate of the lubricating oil, and the channel 34 is defined such that the area defined by the perimeter of the outlet 29*a* and the height of the channel 34 (the distance from the internal surface of the cylinder bore to the bottom of the gap) is significantly smaller compared to the area of the outlet 29*a* of the oil supply hole 29. In this way, the channel 34 functions as a restricting channel.

The piston 13 is fitted into the cylinder bore 12 with a minimum gap C (hereinafter referred to as "the side clearance") necessary for proper reciprocating movements. Because the gap of the channel 34 is larger than side clearance C, a stepped surface 34*a* is provided at the boundary with side clearance C. The stepped surface 34*a* is designed to actively sweep out foreign substances, such as sludge, from the outlet 29*a* of the oil supply hole 29, and is provided in a position that crosses at least the outlet 29*a* of the oil supply hole 29 when the piston 13 is positioned at the bottom dead center during the suction process in which the piston 13 is moved toward the drive chamber 7, and in the present embodiment, in the position outside the cylinder bore 12 (the position indicated by an imaginary line in FIG. 5), which is considered optimal for sweeping out foreign substances.

Therefore, foreign substances, such as sludge, that stick out into the narrow channel 34 from the outlet 29*a* are moved by the reciprocating movements of the piston 13 by adhering to the piston 13 or moved to the drive chamber 7 with the lubricating oil in the channel 34. This action prevents clogging by foreign substances. Moreover, in the present embodiment, the stepped surface 34*a* is provided in certain locations, and therefore, during the suction process of the piston 13, the stepped surface 34*a* can sweep out any foreign substances, such as sludge, that might be present at the outlet 29*a* of the oil supply hole 29 and actively discharge the foreign substances to the drive chamber 7, which has a large space. Furthermore, the flow rate of the lubricating oil that flows in from the oil supply hole 29 is restricted by the channel 34 having a smaller cross-sectional area than the oil supply hole 29, and such flow rate restriction suppresses leakage of discharged refrigerant and the lubricating oil is actively supplied to the sliding surface between the piston 13 and the cylinder bore 12.

Therefore, according to this additional embodiment, as in the embodiment described above, in a lubricating oil supply system for the sliding surface between the piston 13 and the cylinder bore 12, clogging of the oil supply hole 29 by foreign substances, such as sludge, can be prevented, and at the same time, performance degradation due to refrigerant leakage can be avoided by reducing the leakage of the discharged refrigerant.

Note that the present invention is not limited to the above embodiments, and may be modified as needed as long as such modifications do not deviate from the essential nature of the invention.

For example, in the embodiment in which the radial bearing 10 is the lubrication target, the single sweep-out groove 33 is provided on the external surface of the rotating member 30. However, this groove may be increased in number or eliminated. The rotating member 30 may also be integrally formed with the drive shaft 8.

In the embodiment in which the sliding surface between the piston 13 and the cylinder bore 12 is the lubrication target, the channel 34 is defined on the external surface of the piston 13. However, a gap may be provided around the entire perimeter of the piston, i.e., the channel 34 may be formed between the piston 13 and the cylinder bore 12 by forming a smaller-diameter area.

Also, in the embodiment in which the sliding surface between the piston 13 and the cylinder bore 12 is the lubrication target, the stepped surface 34*a* formed on the piston 13 is designed to actively sweep out foreign substances, such as sludge, and is provided in the position that crosses the outlet 29*a* of the oil supply hole 29 during the reciprocating movements of the piston 13, and more preferably in the position outside the cylinder bore 12. However, the stepped surface 34*a* is not be restricted to said position, and it may be provided in a position that does not cross the outlet 29*a* when the piston 13 moves to the bottom dead center. Note that such stepped surface 34*a* will have a function of restricting foreign substances, such as sludge, from discharging toward the head of the piston 13.

Furthermore, the present invention can of course be applied to other compressors in addition to the swash plate type compressors shown in the figures, and the oil separator 23 also is not limited to the centrifugal type shown in the figures, and other types may be used without any problems.

INDUSTRIAL APPLICABILITY

As explained in detail above, the present invention can, in a compressor, prevent clogging of the lubricant oil supply hole by foreign substances, such as sludge, and can avoid performance degradation due to leakage of the discharged refrigerant.

What is claimed is:

1. A compressor comprising:

a lubrication target area;

an oil supply hole for guiding lubricating oil to said lubrication target area;

a flow-restricting channel comprising a gap between a cylindrical chamber and a member that rotates or reciprocates inside the cylindrical chamber;

an outlet of said oil supply hole communicating with the flow-restricting channel;

wherein the flow-restricting channel gap is sufficiently narrow such that the area of a cylindrical surface that is defined by the perimeter of the outlet of said oil supply hole and the height of the flow-restricting channel gap is less than the area of the outlet of said oil supply hole; and wherein foreign substances are swept out from said outlet by the reciprocating or rotating member.

2. The compressor according to claim 1, wherein said lubricating oil has been separated from a refrigerant and is guided to said lubrication target area based on a pressure difference between a discharge side and a suction side of the compressor.

3. The compressor according to claim 2, wherein said refrigerant is carbon dioxide.

4. The compressor according to claim 1, wherein said channel comprises a gap defined between an external surface of a rotating member disposed on a drive shaft and an internal surface of a circular hole that rotatably supports the rotating member.

5. The compressor according to claim 4, wherein the external surface of said rotating member has a foreign substance sweep-out groove that intermittently communicates with the outlet of said oil supply hole.

6. The compressor according to claim 1, wherein said channel comprises a gap defined between an external surface of a piston that linearly reciprocates and an internal surface of a cylinder bore that slidably supports the piston, and said gap is larger than a side clearance defined between the external surface of the piston and the internal surface of the cylinder bore on a head side of said piston so as to define a stepped surface in a boundary with said side clearance.

7. The compressor according to claim 6, wherein said stepped surface is provided in a position that crosses the outlet of said oil supply hole when said piston moves toward bottom dead center.

8. The compressor according to claim 6, wherein said stepped surface extends outside said cylinder bore when said piston is positioned at bottom dead center.

9. The compressor according to claim 6, wherein said channel comprises a groove that is provided on the external surface of said piston and that extends in the axial direction.

10. A method of lubricating a compressor having a lubrication target area to be lubricated, an oil supply hole for guiding lubricating oil to said lubrication target area, and a flow-restricting channel communicated to an outlet of the oil supply hole, and in which said channel comprises a gap defined between a cylindrical hole and a member that rotates or reciprocates inside the cylindrical hole, the method comprising:

restricting a flow rate of the lubricating oil discharged through the outlet of said oil supply hole based on a restricting effect of said channel and sweeping out foreign substances from said outlet using the rotational or reciprocating linear movements of the member that rotates or reciprocates inside the cylindrical hole.

* * * * *